United States Patent [19]

Kubota et al.

[11] 4,398,320

[45] Aug. 16, 1983

[54] METHOD AND APPARATUS FOR TRANSMITTING DRIVING POWER IN DRAFTING DEVICE OF SPINNING FRAME

[75] Inventors: Nobunori Kubota, Kyoto; Hisaaki Kato, Shiga; Teruo Nakayama, Ohtsu, all of Japan

[73] Assignee: Murata Kikai Kabushiki Kaisha, Japan

[21] Appl. No.: 257,510

[22] Filed: Apr. 27, 1981

[30] Foreign Application Priority Data

Apr. 30, 1980 [JP] Japan ..... 55-58905

[51] Int. Cl.[3] ..... D01H 1/22

[52] U.S. Cl. ..... 19/236; 19/244; 19/258; 19/293

[58] Field of Search ..... 19/236, 244, 258, 293

[56] References Cited

U.S. PATENT DOCUMENTS

| | | | |
|---|---|---|---|
| 3,341,902 | 9/1967 | Yano | 19/244 X |
| 3,748,694 | 7/1973 | Staneff | 19/293 X |
| 3,748,695 | 7/1973 | Shino et al. | 19/293 |
| 4,161,862 | 7/1979 | Hartmannsgruber et al. | 19/293 X |
| 4,314,388 | 2/1982 | Hartmannsgruber et al. | 19/293 |
| 4,332,059 | 6/1982 | Bischofberger et al. | 19/293 X |

*Primary Examiner*—Louis Rimrodt

*Attorney, Agent, or Firm*—Barnes, Kisselle, Raisch, Choate, Whittemore & Hulbert

[57] ABSTRACT

A method and apparatus for transmitting a driving power in a drafting device of a spinning frame. In the drafting device comprising a pair of back rollers, middle rollers and front rollers arranged in order, the driving power for the middle rollers is transmitted through a transmission passage different from a transmission passage for transmitting the driving power for the back rollers and front rollers.

12 Claims, 4 Drawing Figures

METHOD AND APPARATUS FOR TRANSMITTING DRIVING POWER IN DRAFTING DEVICE OF SPINNING FRAME

BACKGROUND OF THE INVENTION

The draft apparatus is indispensable for a spinning frame and according to the conventional drafting method, drafting is gradually accomplished through the roving step and the subsequent spinning step. We, the applicants of the present application, have invented a novel high draft apparatus comprising back rollers, apron-provided middle rollers and front rollers being arranged in succession along a yarn passage, in which the roving step is omitted.

In a drafting device of the above-mentioned type, a driving power for the drafting device is transmitted through reduction gears and the like from a driving motor for driving take-up rollers and friction rollers in common. In this drafting device, speeds of back rollers, middle rollers and front rollers are changed through reduction gears and the like according to the draft ratio, and these rollers are co-operatively rotated.

The middle rollers disposed in the above-mentioned drafting device are provided with an apron for controlling the draft unevenness, and non-uniform rotations and vibrations are more readily caused in the middle rollers by influences of the apron than in other rollers. In the high drafting device, the influences of the apron are especially serious because the rotation speeds are high. If non-uniform rotation and vibration are thus caused in the middle rollers, these non-uniform rotation and vibration are propagated to the back rollers and front rollers rotated co-operatively with the middle rollers, and bad influences are imposed on the properties of spun yarns, such as the yarn evenness and tenacity. Since the front rollers are rotated at a higher speed than other rollers, the front rollers are very readily influenced even by very slight non-uniform rotation or vibration propagated thereto.

SUMMARY OF THE INVENTION

The present invention relates to a method and apparatus for transmitting a driving power in a drafting device of a spinning frame. More particularly, the present invention relates to a power-transmitting method and apparatus which exert excellent effects when the method and apparatus are applied to a high drafting device where the roving step is omitted.

An object of the present invention is to provide a method and apparatus for transmitting a driving power in a drafting device of a spinning frame, in which non-uniform rotation and vibration occurring in middle rollers are not propagated to other rollers and high quality spun yarns can be obtained.

According to the present invention, back rollers, middle rollers provided with an apron and front rollers are arranged in succession along a yarn passage and non-uniform rotation and vibration occurring in the middle rollers at the drafting step are prevented from being propagated to the back rollers and front rollers by obtaining the rotation for the back rollers and front rollers from a driving power source different from the driving power source for the middle rollers or from a driving zone which is not influenced by the middle rollers. Therefore, according to the present invention, occurrence of uneven drafting is effectively prevented, and spun yarns excellent in the yarn properties such as yarn uniformity and tenacity can be obtained.

DETAILED DESCRIPTION OF THE INVENTION

The present invention will now be described in detail with reference to embodiments illustrated in the accompanying drawings.

Figure 1:
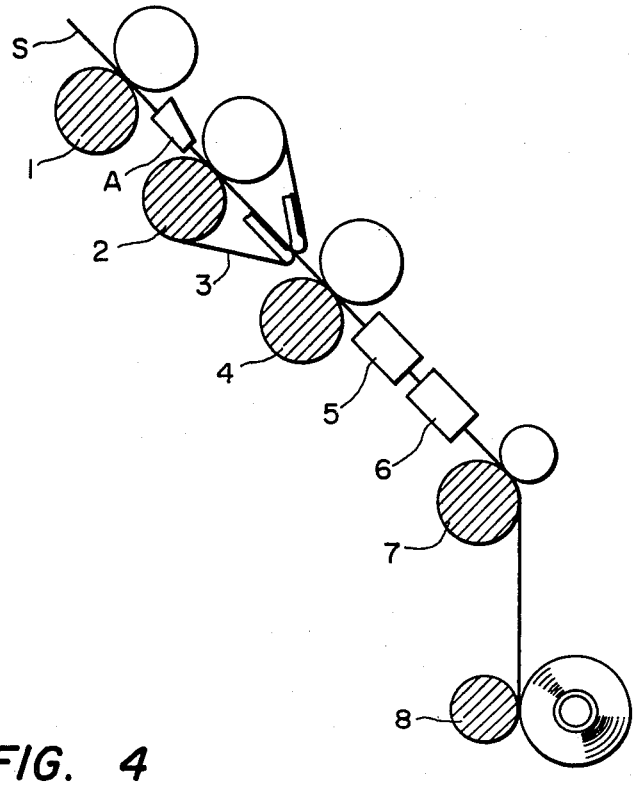
FIG. 1 is a diagram illustrating the step of preparing spun yarns.

Referring to FIG. 1 illustrating steps of preparing spun yarns, a sliver S taken out from a can (not shown) is passed through a pair of upper and lower back rollers 1 rotated positively in the state where they are closely contacted with each other at one ends of the peripheries thereof, a pair of upper and lower middle rollers 2 provided with an apron 3 and rotated positively in the state where they are closely contacted with each other at one ends of the peripheries thereof, and a pair of upper and lower front rollers 4 rotated positively in the state where they are closely contacted with each other at one ends of the peripheries thereof, whereby the sliver S is directly drafted without passing through the roving step. A pneumatic spinning device including two jet nozzles 5 and 6 turing in directions opposite to each other is disposed so that the yarn is turned by one nozzle while a balloon is formed by the other nozzle or the yarn is subjected to suction by one nozzle while the yarn is turned by the other nozzle. The yarn is twisted by this pneumatic spinning device, and is travelled through a take-up roller 7 and arrives at a friction roller 8.

The peripheral speeds of the three pairs of rollers 1, 2 and 4 are different from one another, and the sliver is gradually drafted by virtue of this difference of the peripheral speed. The peripheral speeds of the respective rollers 1, 2 and 4 are adjusted to back roller 1<middle roller 2<front roller 4, and the ratio of the peripheral speeds of these rollers is determined according to the intended draft ratio. When the sliver S is passed through between each pair of the rollers rotated in close contact with each other, the sliver S is flattened and expanded. Accordingly, an adjusting guide A is disposed between the back roller 1 and the middle rollers 2 to prevent abnormal expansion of the width of the sliver S.

Figure 2:
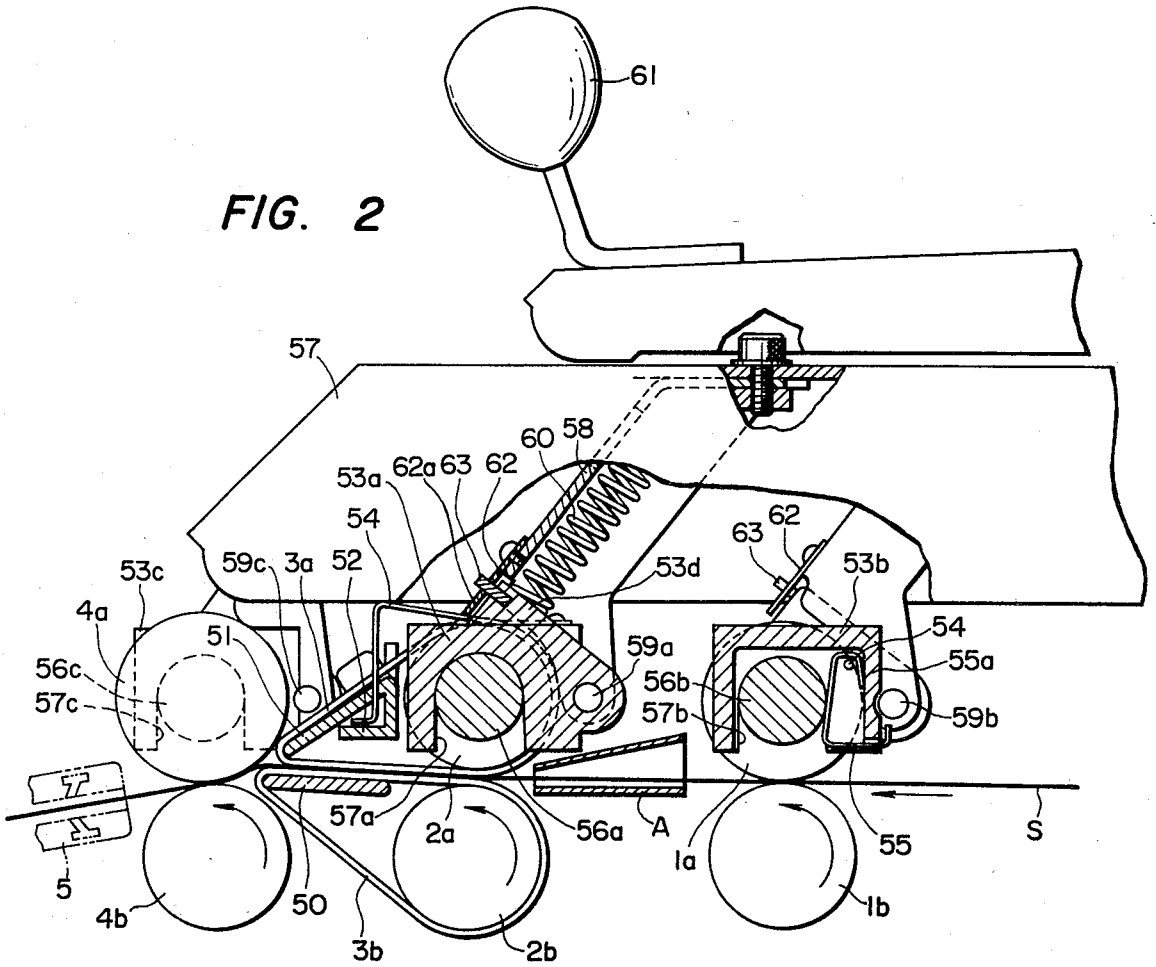
FIG. 2 is a side view illustrating the drafting device in detail.

Referring to FIG. 2 illustrating the drafting device in detail, a top apron 3*a* and a bottom apron 3*b* attached to top and bottom middle rollers 2*a* and 2*b*, that is, a pair of middle rollers 2, respectively, are formed to take a shape of an endless belt, and the aprons 3*a* and 3*b* are travelled with rotation of the middle rollers 2*a* and 2*b* in such a manner that both the aprons 3*a* and 3*b* are pressed to each other. Bad influences such as uneven drafting are brought about on the spun yarn according to the pressing position and pressing force between the aprons 3*a* and 3*b*. As means for eliminating such bad influences as uneven drafting, a tensor bar 50 is disposed on the inner side of the top end of the apron 2b, and this tensor bar 50 is secured by a fixing lever (not shown). Especially good results are obtained when the sliding surface of the tensor bar 50, which falls in sliding contact with the apron 3b, is treated by Teflon processing or the like so as to reduce the frictional resistance.

A cradle 51 is mounted on the inner side of the top end of the top apron 3a, and the other end portion of the cradle 51 is folded back substantially in the triangular form, and the folding edge 52 of the cradle 51 is pressed by a pin 54 screwed and fixed to a bearing 53a. Accordingly, the tensor bar 50 is always pressed by the cradle 51.

Each of the above-mentioned bearing 53a and bearings 53b and 53c has a substantially U-figured section, and a spring 55 is spread on a fixing pin 54 mounted on one end of each bearing. Accordingly, the cradle 51 and shafts 56a, 56b and 56c for supporting the top back roller 1a, top middle roller 2a and top front roller 4a, respectively, are dismountably gripped by side walls 57a, 57b and 57c of the bearings 53a, 53b and 53c, the spring ends 55a and the spring 55 having the fixing pin 54 as fulcrum.

The bearings 53a, 53b and 53c are fitted to a shaft 59 fixed to a roller guide 58 integrally secured to a roller support 57 so that they can turn with the shaft 59 being as the centers. Namely, the end faces 53d of the bearings are pressed by a spring 60 attached to the roller guide and in this state, the bearings are urged by the spring 60 to turn counterclockwise with the shafts 59 being as the centers.

The bottom back roller 1b, bottom middle roller 2b and bottom front roller 4b are arranged to rotate at the constant positions by the locking action of a known fixing lever 61, and the rollers 1a, 2a and 4a located at positions confronting the rollers 1b, 2b and 4b always press the rollers 1b, 2b and 4b by constant pressing forces. In order to control the turning ranges of the bearings 53a, 53b and 53c when the fixing lever 61 is unlocked, guide pins 63 secured to the respective bearings 53a, 53b and 53c are fitted in long grooves 62a formed on plates 62 integrally secured to the roller guide 58. The turning ranges of the bearings are regulated by these long grooves 62a.

Each of the rollers 1, 2 and 4 consists of a pair of rollers, but only the bottom rollers 1b, 2b and 4b are positively rotated and the top rollers 1a, 2a and 4a are pressed to the bottom rollers 1b, 2b and 4b by the above-mentioned pressing means and are rotated with rotation of the bottom rollers 1b, 2b and 4b.

Figure 3:
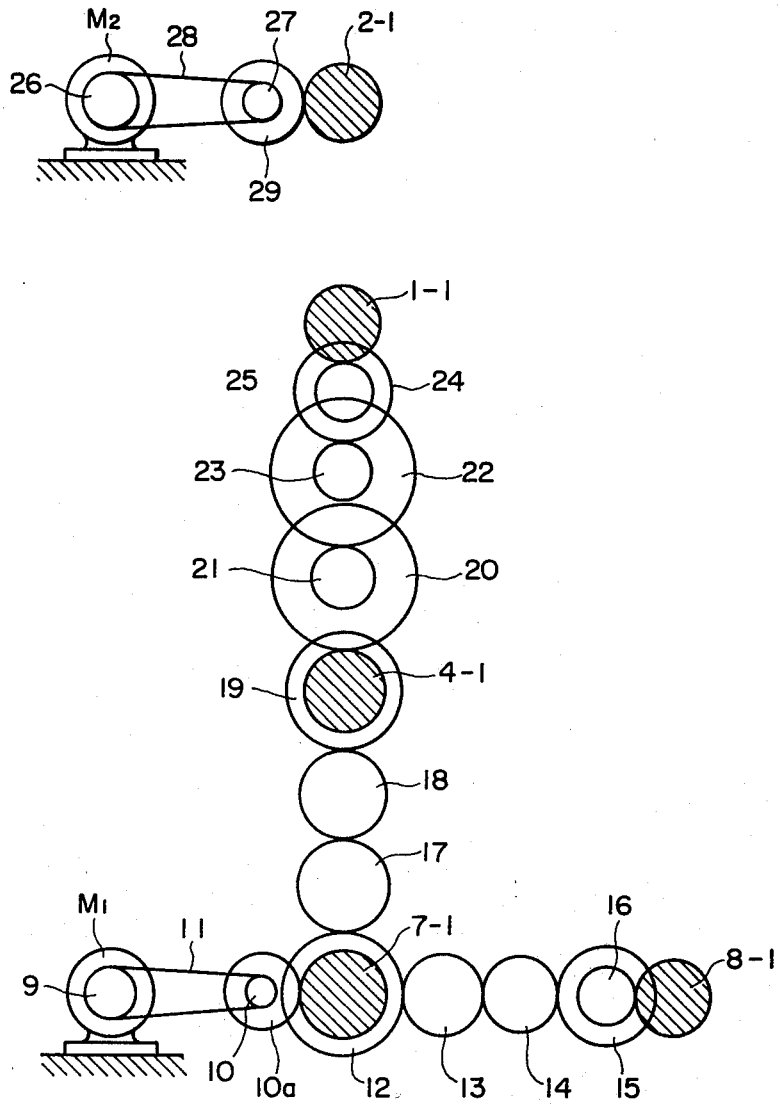
FIG. 3 is a diagram illustrating a transmission mechanism in one embodiment of the driving zone in the spinning frame according to the present invention.

Referring to FIG. 3 illustrating the driving zone of the above-mentioned drafting device, rotation of a driving motor M1 is transmitted to a gear 10a integrally secured to a pulley 10 through an endless belt 11 hung on pulleys 9 and 10 to drive a driving gear 7-1 connected directly to the take-up roller 7. The rotation transmitted to the driving gear 7-1 of the take-up roller 7 is transmitted to reduction gears 13, 14 and 15 through a gear 12 connected directly to said gear 7-1 and also to a driving gear 8-1 connected directly to the friction roller 8 through a gear 16 connected directly to the gear 15. Furthermore, the rotation is transmitted to a driving gear 4-1 connected directly to the front roller 4b through reduction gears 17, 18 and 19. The rotation transmitted to the driving gear 4-1 of the front roller 4b positively drives the front roller 4b and is transmitted to a driving gear 1-1 connected directly to the back roller 1b through reduction gears 20 through 25.

The rotation of a driving motor M2 is transmitted to a gear 29 integrally secured to a pulley 27 through an endless belt 28 hung on pulleys 26 and 27 to drive a driving gear 2-1 connected directly to the middle roller 2b. Accordingly, the rotation of the middle roller 2b and the rotation of the back roller 1b, front roller 4b, take-up roller 7 and friction roller 8 are transmitted from the independent driving power sources M1 and M2, respectively.

Figure 4:
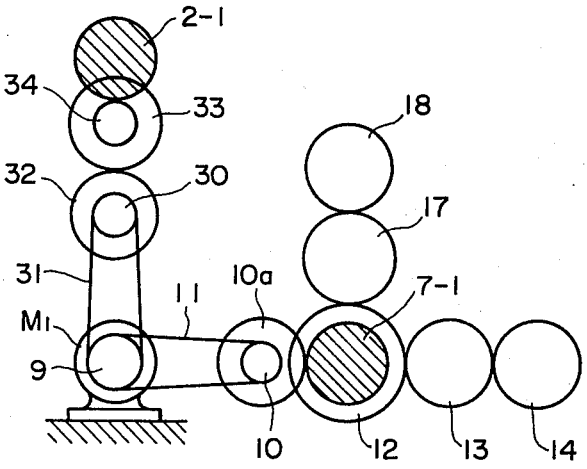
FIG. 4 is a diagram illustrating a transmission mechanism in another embodiment of the driving zone according to the present invention.

In the present invention, the above-mentioned two rotations may be transmitted from one driving power source as shown in FIG. 4. In the embodiment shown in FIG. 4, the rotation of the driving motor M1 is transmitted to the take-up roller 7, friction roller 8, front roller 4b and back roller 1b in the above-mentioned manner, and simultaneously, this rotation is transmitted to a reduction gear 32 through an endless belt 31 hung between pulleys 9 and 30 and further to the driving gear 2-1 connected directly to the middle roller 2b through reduction gears 33 and 34.

The nubmer of the rotation transmitted to the middle rollers 2 from the independent driving power source is determined according to the draft ratio between the back rollers 1 and front rollers 4. More specifically, if the total draft ratio is set between the back rollers 1 and front rollers 4, the break draft ratio between the back rollers 1 and middle rollers 2 should naturally be determined. Accordingly, the rotation number of the back rollers 1 is detected by a rotation meter or the like, and the rotation number of the middle rollers 2 is calculated and determined from the so detected rotation number of the back rollers 1 and the above-mentioned break draft ratio. Accordingly, if a speed change motor or the like is used as the driving power source of the middle rollers 2, the rotation number of the middle rollers 2 can easily be determined.

As will be apparent from the foregoing description, high quality spun yarns can be obtained if the middle rollers 2 are driven by a driving power source independent from the driving power source for the back rollers 1 and front rollers 4 or if the rotation of the back rollers 1b and front roller 4b is obtained from the driving zone which is not influenced by non-uniform rotation and vibration occurring in the middle rollers 2.

If the back rollers 1, middle rollers 2 and front rollers 4 are co-operatively connected to one another through reduction gears and the like, non-uniform rotation and vibration are caused in the middle rollers 2 because of the friction resistance and the like factors of the apron 3 attached to the middle rollers 2. The non-uniform rotation and vibration occurring in the middle rollers 2 are reversely propagated through the reduction gears to cause non-uniform rotation and vibration in the back rollers 1 and front rollers 4, whereby the quality of spun yarns being produced is adversely affected. Incidentally, since the rotation speed of the front rollers 4 is higher than the rotation speed of the back rollers 1, the yarn quality is seriously influenced by non-uniform rotation and vibration occurring in the middle rollers 2 even if they are very slight non-uniform rotation and vibration. Especially in a pneumatic spinning frame in which the spinning speed is at least 10 times the spinning speed in a ring spinning frame, influences of such non-uniform rotation and vibration on the yarn quality are prominently serious. Accordingly, in the present invention, in order to eliminate influences of non-uniform rotation and vibration occurring in the middle rollers 2, a driving power source independent from the driving power source for the back rollers 1 and front rollers 4 is disposed for the middle rollers 2, or when one common driving power source is disposed for the respective rollers, the driving power for the back and front rollers is obtained from the driving zone which is not influenced by the middle rollers 2, that is, the driving power for the back rollers 1*b* and front roller 4*b* is obtained from the common driving power source through a transmission course different from the transmission cource for the driving power for the middle roller 2*b* or from an intermediate portion of the transmission course which is not influenced by the middle rollers 2. By this arrangement, occurrence of non-uniform rotation or vibration in the back rollers 1 and front rollers 4 can be prevented effectively.

In the foregoing embodiments, endless belts and pulleys are used as means for transmitting the driving power from the driving power source. Of course, in the present invention, there may be adopted other transmission means such as chains and sprockets. The number of the reduction gears disposed among the back rollers 1, front rollers 4, take-up roller 7 and friction roller 8 is not limited to the number of the reduction gears shown in the drawings. Furthermore, speed change means disposed between belts and pulleys may be adopted instead of these reduction gears.

What is claimed is:

1. A method for transmitting a driving power in a drafting device of a spinning frame, said drafting device comprising a pair of top and bottom back rollers rotated positively in close contact with each other along a yarn passage, a pair of top and bottom middle rollers provided with an apron and rotated positively in close contact with each other along the yarn passage and a pair of top and bottom front rollers rotated positively in close contact with each other along the yarn passage and a pair of top and bottom front rollers rotated positively in close contact with each other along the yarn passage, characterized in that the driving power for the back and front rollers is transmitted through the same transmission passage and in that the driving power for the middle rollers is transmitted through a transmission passage different from the transmission passage for transmitting the driving power for the back rollers and front rollers.

2. The method claimed in claim 1, and further including the step of providing the driving power for the back and front rollers from a single power source and providing the driving power for the middle rollers from a separate power source.

3. The method as claimed in claim 1, and further including the step of providing the driving power for all of the back rollers, middle rollers and front rollers from a single power source.

4. An apparatus for transmitting a driving power in a drafting device of a spinning frame, said drafting device comprising a pair of top and bottom back rollers rotated positively in close contact with each other along a yarn passage, a pair of top and bottom middle rollers provided with an apron and rotated positively in close contact with each other along the yarn passage and a pair of top and bottom front rollers rotated positively in close contact with each other along the yarn passage, in which supporting shafts for supporting the top back roller, top middle roller and top front roller, respectively, are gripped dismountably by side walls of bearings which have a substantially U-figured section, spring ends and springs having fixing pins as fulcrum, said springs being spread on the fixing pin mounted one end of each bearing, through reduction gears rotation is transmitted to drive the driving gear connected to the bottom front roller and is transmitted to drive the driving gear connected to the bottom back roller through separate reduction gears rotation is transmitted to drive the driving gear connected to the bottom middle roller, and the top back roller, top middle roller and top front roller are arranged to be rotated at the contact position with the bottom back roller, bottom middle roller and bottom front roller by the locking action of a fixing lever to be pressed by contact pressing force.

5. An apparatus for transmitting a driving power as claimed in claim 4, wherein only one driving power source is applied, that is, the rotation of a driving motor is transmitted to the bottom front roller and bottom back roller and simultaneously this rotation is transmitted to reduction gears through an endless belt hung between the pulley of the motor and a pulley secured to the reduction gear and further to the driving gear connected to the bottom middle roller through the reduction gears.

6. Structure for transmitting driving power in a drafting device of a spinning frame which drafting device includes a pair of top and bottom back rollers rotated positively in close contact with each other along a yarn passage, a pair of top and bottom middle rollers provided with an apron and rotated positively in close contact with each other along the yarn passage and a pair of top and bottom front rollers rotated positively in close contact with each other along the yarn passage comprising a single transmission passage for driving power to the back and front rollers and a separate transmission passage for driving power for the middle rollers.

7. Structure as set forth in claim 6, including a separate driving power source for the back and front rollers and a separate driving power source for the middle rollers.

8. Structure as set forth in claim 6, and further including a single driving power source for all of the back rollers, middle rollers and front rollers.

9. Structure as set forth in claim 6, wherein each of the top rollers is mounted for rotation about its own axis in a separate bearing pivotally mounted on an axis parallel to the axis of the associated top roller for movement of the associated top roller toward and away from the associated bottom roller and spring means for urging the bearing about the pivot mounting therefore toward the associated bottom roller.

10. Structure as set forth in claim 9, and further including pin and slot means operable between the bearings and support structure therefore for limiting the pivotal movement of the bearings.

11. Structure as set forth in claim 9, wherein the bearings are provided with a substantially U-shaped cross section transversely of the rollers and further including spring means provided within the U-shaped cross section of the bearings for releasably securing the top rolls in the bearings.

12. Structure as set forth in claim 9, and further including apron means positioned between the middle roller and front roller including a tensor bar operably associated with the bottom middle roller and an endless belt extending around the bottom middle roller and the tensor bar and a craddle operably associated with the upper middle roller and an endless belt passing around the upper middle roller and craddle and spring means for urging the craddle toward the tensor bar.

* * * * *